US005184740A

United States Patent [19]

Mandrell, II et al.

[11] Patent Number: 5,184,740

[45] Date of Patent: Feb. 9, 1993

[54] CONTAINER CAP

[76] Inventors: Gerald W. Mandrell, II, 2564 Lumpkin Rd. Apt. E-34, Augusta, Ga. 30906; Eddie J. Humphres, P.O. Box 452, Red Bay, Ala. 35582; Floyd W. Flanigan, 3866 Old Savannah Rd. #287, Augusta, Ga. 30906; Bradley W. Pittman, 198 Crystal Creek La., Westminster, S.C. 29693

[21] Appl. No.: 839,570

[22] Filed: Feb. 14, 1992

[51] Int. Cl.[5] ..... B65D 51/16

[52] U.S. Cl. ..... 215/315; 215/305; 215/311; 220/206; 220/203; 220/231; 220/755

[58] Field of Search ..... 215/311, 314, 305, 295, 215/302, 303, 315; 220/284, 260, 203, 206, 209, 367, 94 A, 231; 222/484, 483, 481

[56] References Cited

U.S. PATENT DOCUMENTS

| | | | |
|---|---|---|---|
| 48,341 | 6/1865 | Kloenne | 215/315 |
| 316,147 | 4/1885 | Heysinger | 215/315 X |
| 1,609,063 | 11/1926 | Closson | 220/284 |
| 3,157,323 | 11/1964 | Kitterman | 215/314 X |
| 4,380,304 | 4/1983 | Anderson | 220/94 A |
| 4,469,235 | 9/1984 | Parker | 215/302 X |
| 4,842,158 | 6/1989 | Reyes, Jr. | 215/100 A X |

FOREIGN PATENT DOCUMENTS

| | | | |
|---|---|---|---|
| 508706 | 10/1920 | France | 215/314 |
| 724431 | 4/1932 | France | 215/305 |
| 12520 | of 1899 | United Kingdom | 215/305 |
| 16958 | of 1902 | United Kingdom | 215/314 |
| 6080 | of 1914 | United Kingdom | 215/314 |
| 144571 | 6/1920 | United Kingdom | 215/305 |

*Primary Examiner*—Stephen P. Garbe
*Assistant Examiner*—Paul Schwarz
*Attorney, Agent, or Firm*—Leon Gilden

[57] ABSTRACT

A container cap includes a cylindrical cap portion to secure to an upper distal end of an externally threaded beverage container and the like. The cap structure includes a top wall orthogonally oriented relative to an axis of the cap, and is further formed with a central boss coaxially aligned and diametrically positioned relative to the top wall to include first and second ring members that are diametrically aligned with the top wall and relative to one another to permit manual insertion of an individual's fingers to assist in the removal and application of the cap structure to the beverage container. A modification of the invention includes a vent member arranged to permit ease of ascertaining freshness of a fluid within the beverage container by permitting depressing of an associated valve structure directed through the central boss.

1 Claim, 4 Drawing Sheets

CONTAINER CAP

BACKGROUND OF THE INVENTION

1. Field of the Invention

The field of invention relates to cap structure, and more particularly pertains to a new and improved container cap wherein the same is arranged for the ease of manipulation of a cap relative to a beverage container.

2. Description of the Prior Art

Container caps per se are readily available for threaded inter-engagement with associated container structure. The prior art is typically of a similar dimensional relationship relative to the underlying cap structure, whereas the instant invention attempts to overcome deficiencies of the prior art by providing a cap structure to include finger rings to enhance the removal and securement of the cap relative to the container. Examples of prior art cap members are set forth in the U.S. Pat. Nos. 4,842,158 to Reyes, Jr. and 4,380,304 to Anderson.

Accordingly, it may be appreciated that there continues to be a need for a new and improved container cap as set forth by the instant invention which addresses the problems of ease of use as well as effectiveness in construction and in this respect, the present invention substantially fulfills this need.

SUMMARY OF THE INVENTION

In view of the foregoing disadvantages inherent in the known types of container cap structure now present in the prior art, the present invention provides a container cap wherein the same is arranged to position finger rings to a top wall of the cap for ease of manipulation of the cap relative to a beverage container. As such, the general purpose of the present invention, which will be described subsequently in greater detail, is to provide a new and improved container cap which has all the advantages of the prior art container caps and none of the disadvantages.

To attain this, the present invention provides a container cap including a cylindrical cap portion to secure to an upper distal end of an externally threaded beverage container and the like. The cap structure includes a top wall orthogonally oriented relative to an axis of the cap, and is further formed with a central boss coaxially aligned and diametrically positioned relative to the top wall to include first and second ring members that are diametrically aligned with the top wall and relative to one another to permit manual insertion of an individual's fingers to assist in the removal and application of the cap structure to the beverage container. A modification of the invention includes a vent member arranged to permit ease of ascertaining freshness of a fluid within the beverage container by permitting depressing of an associated valve structure directed through the central boss.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of tee present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container cap which has all the advantages of the prior art container caps and none of the disadvantages.

It is another object of the present invention to provide a new and improved container cap which may be easily and efficiently manufactured and marketed.

It is a further object of the present invention to provide a new and improved container cap which is of a durable and reliable construction.

An even further object of the present invention is to provide a new and improved container cap which is susceptible of a low cost of manufacture with regard to both materials and labor, and which accordingly is then susceptible of low prices of sale to the consuming public, thereby making such container caps economically available to the buying public.

Still yet another object of the present invention is to provide a new and improved container cap which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
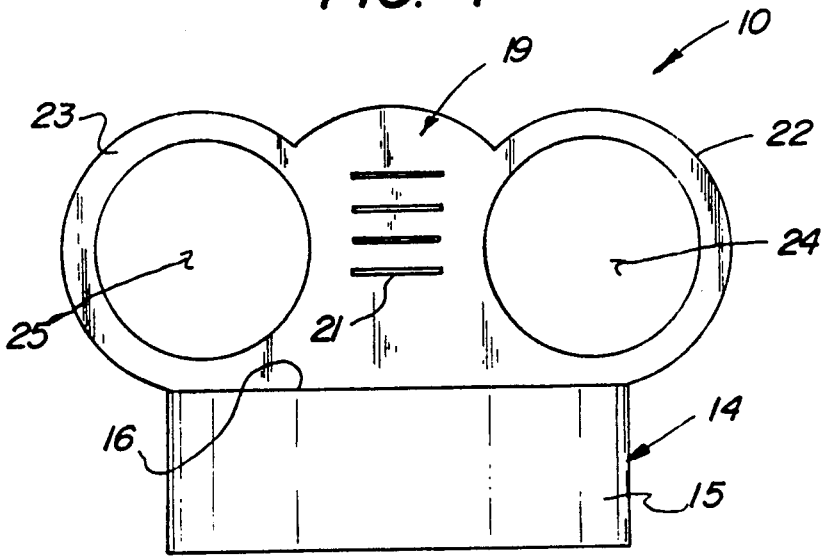
FIG. 1 is an orthographic side view of the instant invention.

With reference now to the drawings, and in particular to FIGS. 1 to 6 thereof, a new and improved container cap embodying the principles and concepts of the present invention and generally designated by the reference numerals 10 and 10*a* will be described.

Figure 2:
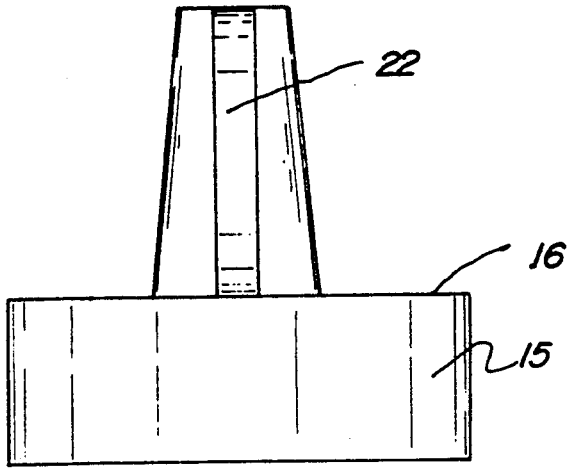
FIG. 2 is an orthographic end view of the instant invention.
Figure 3:
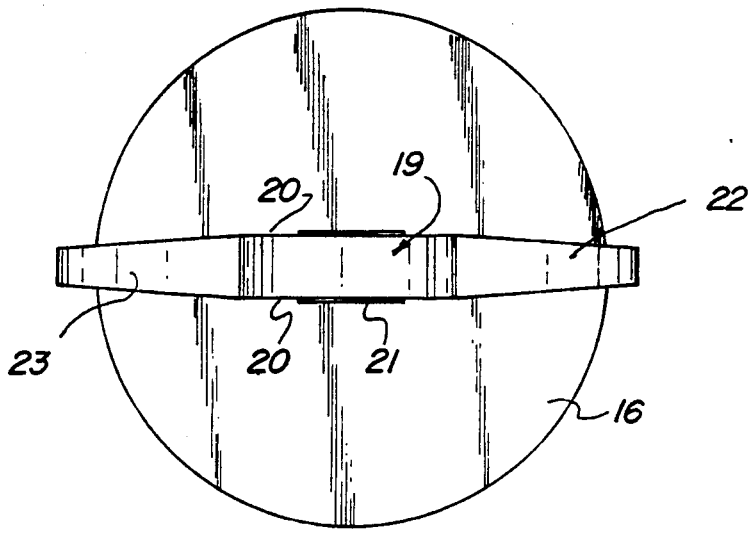
FIG. 3 is an orthographic top view of the instant invention.

More specifically, the container cap 10 of the instant invention, as set forth in the FIGS. 1-3, essentially comprises a cap structure arranged for securement to an underlying beverage container 11 (see FIG. 6 for example), with the beverage container including an externally threaded spout 12, with a spout upper rim arranged for receiving the container cap 10 or 10*a* of the invention.

The closure 14 includes a cylindrical side wall 15 formed with an internally threaded side wall interior surface 17 arranged for inter-engagement with the externally threaded spout 12. A closure cap top wall 16 is orthogonally oriented relative to the cylindrical side wall 15 to arrange for sealing relationship of the closure 14 when secured to the spout 12 when the spout is directed into the closure 14 towards the top wall bottom surface 18.

A central boss 19 is fixedly and orthogonally and coaxially oriented relative to the cylindrical side wall 15 and integrally mounted to the top wall 16. The central boss 19 includes spaced boss side walls 20, with the side walls including parallel ribs 21 projecting from the side walls to enhance manual engagement of the central boss 19. Respective first and second ring members 22 and 23 are integrally and fixedly mounted to opposed sides of the central boss 19 and to the closure top wall 16 to a top surface thereof The ring members 22 and 23 extend laterally beyond a diametrical relationship relative to the top wall 16 and include respective first and second bores 24 and 25 through the respective first and second ring members 22 and 23. The bores 24 and 25 are diametrically aligned to each other, as well as to the closure 14 in a position on opposed sides of the central boss to permit greatest leveraging advantage when an individual directs fingers through the bores 24 and 25 to permit ease of manipulation of the cap relative to the beverage container in an assembly and disassembly procedure.

Figure 4:
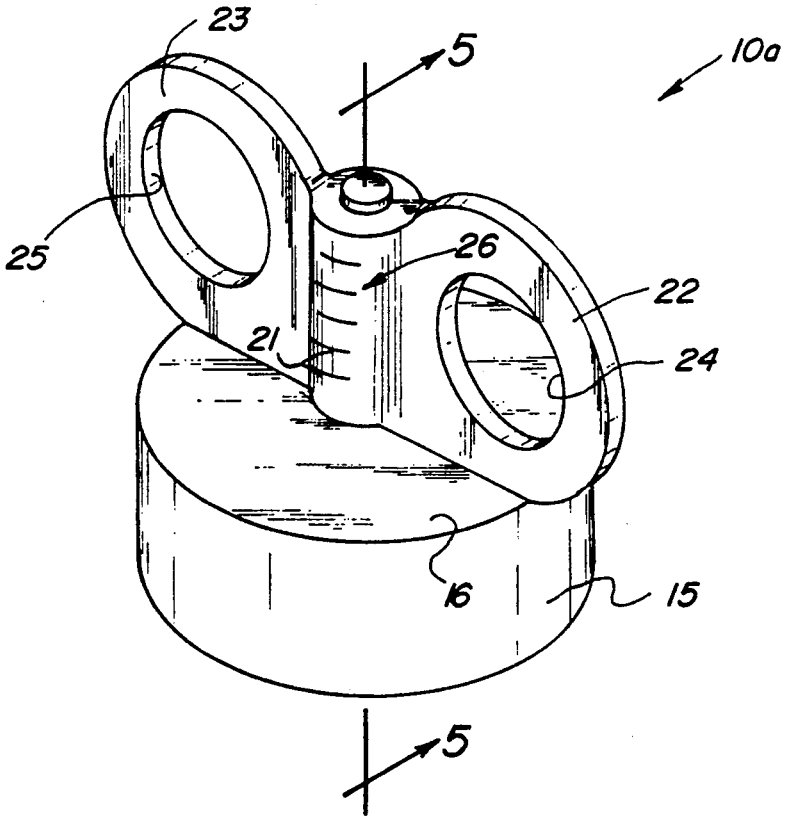
FIG. 4 is an isometric illustration of a modification of the invention.
Figure 5:
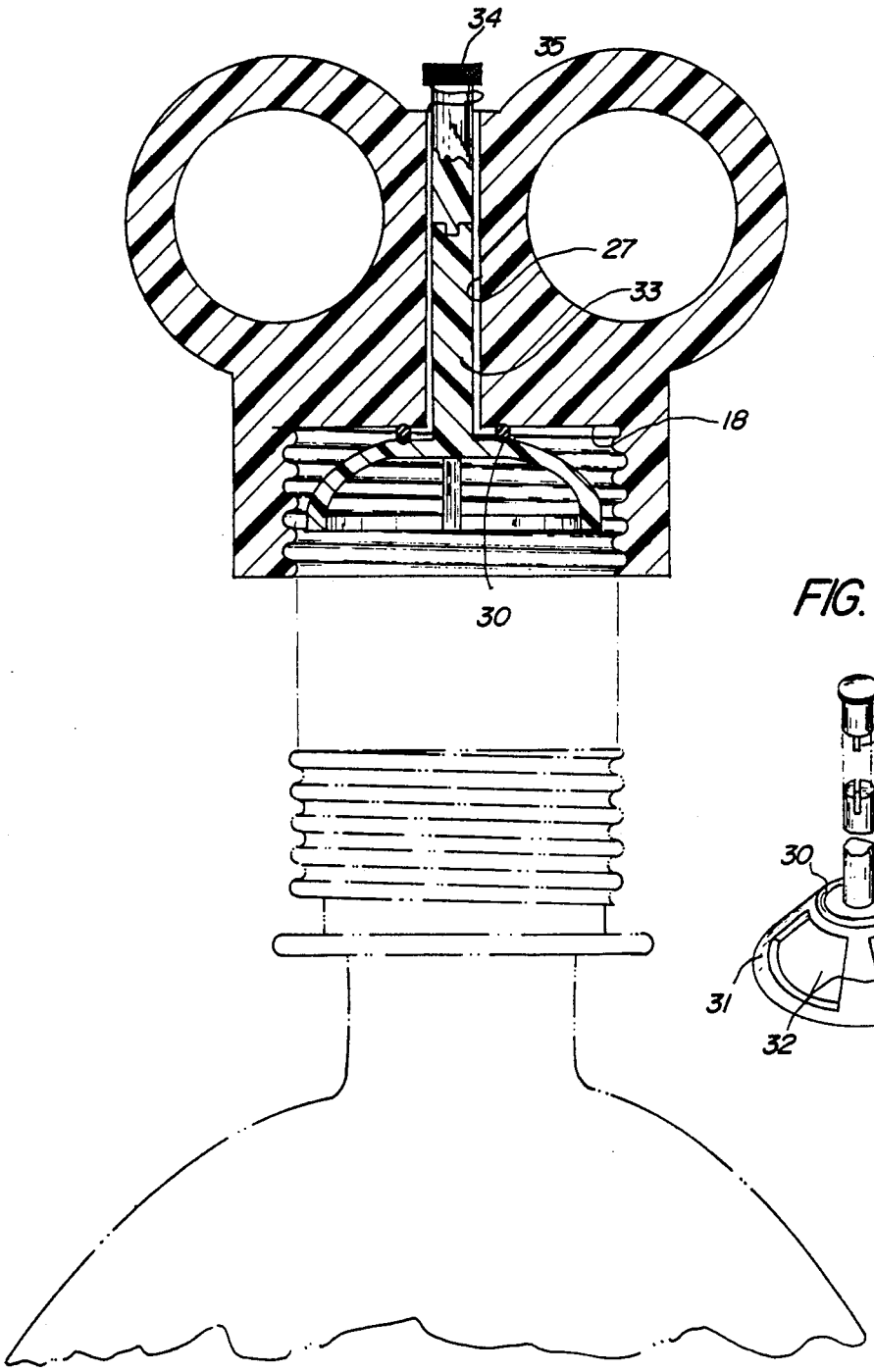
FIG. 5 is an orthographic view, taken along the lines 5—5 of FIG. 4 in the direction indicated by the arrows.
Figure 5A:
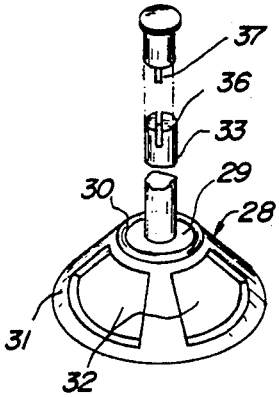
FIG. 5*a* is an isometric illustration of the valve member utilized by the invention, as set forth in the FIGS. 4, 5, and 6.
Figure 6:
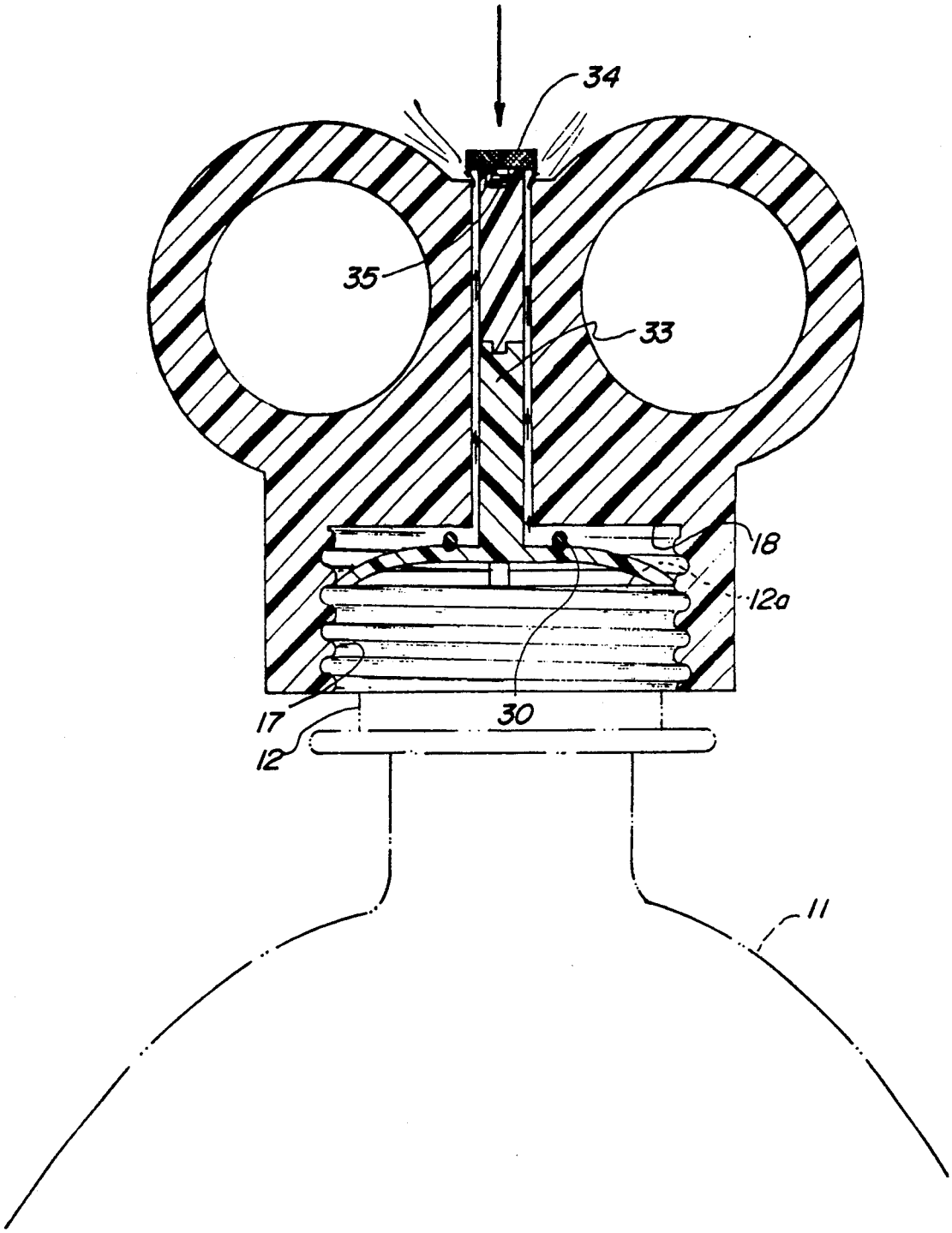
FIG. 6 is an orthographic side view of the cap structure with the valve in a depressed orientation relative to the cap structure.

The FIGS. 4-6 illustrate the use of a modified cap structure 10*a* to include, in addition to the closure 14, a central cylindrical boss 26 coaxially aligned relative to the cylindrical side wall 15 orthogonally and coaxially mounted relative to the top wall 16. The cylindrical boss 26 mounts the first and second ring members 22 and 23 in a manner as set forth above. Further, the central cylindrical boss 26 includes a bore 27 directed coextensively therethrough entering into the closure 14 through the top wall 16. A valve member 28 is mounted within the bore 27 and the closure 14 to include a valve member planar top wall 29 formed with a sealing ring 30 concentrically mounted relative to the bore 27 in a surrounding relationship, as well as to a valve member rod 33 coaxially and integrally mounted to the valve member planar top wall 29 extending upwardly thereof through the bore 27. The valve member rod 33 terminates in a rod groove 36 at its upper distal end to receive a plunger head rib 37 at a lower end of a plunger rod to enhance inter-engagement of the plunger head 34 relative to the rod 33 for ease of assembly and manufacture of the organization. A spring 35 is captured between the plunger head 34 and an upper distal end of the central boss 26 to maintain the valve in a raised orientation relative to the closure 14. An arcuate flexible side wall 31 extends downwardly relative to and projecting towards the threaded side wall 17 of the closure 14. The arcuate flexible side wall 31 includes a plurality of window openings 32 (see FIG. 5*a*) to permit gaseous flow therethrough as well as fragrance associated with a beverage or fluid within the container 11. Normally, the sealing ring 30 is in contiguous communication with the top wall bottom surface 18. Upon projection of the plunger rod head 34 downwardly, a displacement is effected of the sealing ring relative to the top wall bottom surface 18 to permit entrapped gas and fragrance directed through the bore 27 about the valve member rod 33 and the plunger rod. It should be noted that the flexible nature of the side wall 31 of the valve member permits deflection into engagement With the internally threaded interior side wall surface 17, but yet permits the directing of fluid and gases therethrough limiting gaseous loss from within the beverage container while simultaneously permitting a "freshness check" of contents therewithin. The boss bore 27 includes a cylindrical boss interior wall to permit gaseous flow between the valve member rod 33, the plunger, and the cylindrical boss interior wall.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container cap arranged for securement to a beverage container, the beverage container including an externally threaded spout and the spout including an upper rim, the container cap including a closure member, the closure member including a cylindrical side wall formed about predetermined axis and including an internally threaded interior surface arranged for interengagement with the externally threaded spout, and a top wall fixedly mounted to an upper distal end of the cylindrical side wall orthogonally oriented relative to the axis, the top wall including a top wall bottom surface and a top wall top surface, and the top wall top surface including a rigid central boss fixedly and orthogonally mounted coaxially aligned with the predetermined axis, the central boss including spaced side walls, the side walls each including spaced parallel ribs to enhance manual grasping of the central boss, and a first ring member and a second ring member fixedly mounted to opposed sides of the central boss, with the first ring member and the second ring member integrally mounted to the top wall top surface and projecting laterally beyond the top wall, and the first ring member including a first bore directed therethrough, the second ring member including a second bore directed therethrough, wherein the first bore and the second bore project beyond the cylindrical side wall, and the central boss includes a boss bore coaxially aligned with the predetermined axis directed coextensively through the central boss and through the top wall, and the central boss slidably mounting a valve member assembly thereto, and the valve member assembly includes a valve member top wall arranged parallel relative to the top wall bottom surface, with the top wall including a torroidal sealing ring concentrically positioned about the boss bore directed through the top wall, with the valve member top wall including a rigid valve member rod fixedly and orthogonally mounted to the valve member top wall and the valve member rod directed into the boss bore, the valve member rod including a plunger rod extending from the valve member rod through the boss bore, and the plunger rod terminating in a plunger head, and a spring member captured between the plunger head and the boss, and an arcuate flexible side wall extending downwardly of the valve member top wall canted towards the cylindrical side wall interior surface, the arcuate flexible side wall including a plurality of window openings directed therethrough to permit gaseous flow through the window openings, and the valve member rod and the plunger rod are spaced from a cylindrical boss interior wall to permit gaseous flow between the valve member rod, the plunger rod, and the cylindrical boss bore interior wall.

* * * * *